United States Patent [19]

Takeda et al.

[11] Patent Number: 4,792,831

[45] Date of Patent: Dec. 20, 1988

[54] DRY-TYPE DEVELOPING APPARATUS WITH ELASTIC SHEET

[75] Inventors: Kenichi Takeda, Yokohama; Kazuo Kagiura, Tokyo, both of Japan

[73] Assignee: Canon Kabushiki Kaisha, Tokyo, Japan

[21] Appl. No.: 110,785

[22] Filed: Oct. 21, 1987

[30] Foreign Application Priority Data

Oct. 24, 1986 [JP] Japan ..... 61-254293

[51] Int. Cl.[4] ..... G03G 15/08

[52] U.S. Cl. ..... 355/3 DD; 355/140

[58] Field of Search ..... 355/3 DD, 14 D, 3 R, 355/15; 118/657, 658

[56] References Cited

U.S. PATENT DOCUMENTS

| | | | |
|---|---|---|---|
| 4,387,982 | 6/1983 | Stanley | 355/3 DD |
| 4,394,086 | 7/1983 | Hoffman et al. | 355/3 R |
| 4,436,413 | 3/1984 | Oka | 355/15 |
| 4,449,810 | 5/1984 | Ikesue et al. | 355/3 DD |
| 4,592,653 | 6/1986 | Ikeda et al. | 355/3 DD |
| 4,596,455 | 6/1986 | Kohyama et al. | 355/3 DD |
| 4,716,437 | 12/1987 | MacLellan | 355/3 DD |

*Primary Examiner*—A. C. Prescott

*Attorney, Agent, or Firm*—Fitzpatrick, Cella, Harper & Scinto

[57] ABSTRACT

A dry-type developing apparatus includes a developer container for accommodating a magnetic developer, the developer container being provided with an opening, developer carrying member, disposed in the opening, for carrying the magnetic developer out of the developer container. The developer carrying member including a magnetic field generating magnet which is provided with magnetic field generating portions having different polarities arranged in a direction of carrying the magnetic developer, a continuous elastic sheet including a contact portion for contacting the magnetic developer carrier out of the developer container by the developer carrying member. The elastic sheet having upstream and downstream portions which are respectively fixed to the developer container at positions upstream and downstream of the contact portion with respect to movement of the magnetic developer.

17 Claims, 2 Drawing Sheets

DRY-TYPE DEVELOPING APPARATUS WITH ELASTIC SHEET

FIELD OF THE INVENTION AND RELATED ART

The present invention relates to a dry-type developing apparatus with an elastic sheet for developing with a dry (powdery) developer an electric latent image such as an electrostatic latent image, a potential latent image, a magnetic latent image and a resistor pattern latent image.

In a dry-type developing apparatus, some attention has been paid to prevention of developer scattering from a developer container for containing magnetic developer. As for means for accomplishing the prevention, the following is known.

U.S. Pat. No. 4,592,653 discloses an elastic sheet having an end fixed to the developing apparatus and the other end contacted to an image bearing member to prevent the developer from scattering upwardly from the developing zone and an elastic sheet having an end fixed to the copying apparatus and the other end adapted to contact the developer.

U.S. Pat. No. 4,638,760 and U.S. patent application Ser. No. 844,718 filed on Mar. 27, 1986 which have been assigned to the assignee of this application disclose an excellent solution wherein a magnetic developer is prevented from leaking out of a container utilizing a concentrated magnetic field provided by a magnetic member and a magnetic pole, and a solution wherein the magnetic developer is prevented from leaking out of the container while allowing the magnetic developer to be collected into the container. However, it has been found that there exists a particular situation wherein the concentrated magnetic field is not completely effective and can allow the developer scattering when an external impact is imparted thereto, depending on the structure of the developing apparatus or the magnetic developer contained in the container.

U.S. Pat. No. 4,458,627 discloses an elastic sheet contacted to the developer to make it function as an elastic blade to regulate a surface of a developer layer. U.S. Pat. No. 4,632,535 discloses an elastic sheet for guiding a non-magnetic one component toner to a developing sleeve. The former involves a problem that it is easily influenced by the developer powder scattered from the developing zone, particularly when an alternating electric field is formed in the developing zone as disclosed in U.S. Pat. No. 4,292,387 and U.S. Pat. No. 4,395,476. This tendency is more remarkable in the type of developing apparatus as disclosed in Japanese Laid-Open Patent Application No. 32060/1980 and U.S. Pat. No. 4,496,644 wherein the magnetic developer contains magnetic carrier particles and toner particles and wherein the alternating electric field is formed in the developing zone. In the latter (U.S. Pat. No. 4,632,535), it is required that the one component non-magnetic toner be deposited on the sleeve by the electric charge thereof so as to be collected back into the developer container. For this reason, the elastic sheet has to be contacted to the sleeve only with a small pressure. If, however, the amount of the non-magnetic toner in the container is large, the weight thereof becomes influential, resulting in scattering of the non-magnetic toner.

The problem of the developer scattering is particularly significant when the developing apparatus is carried around or when the developing apparatus is mounted into or demounted from an image forming apparatus which is to be used therewith. Therefore, the need and desire exist to solve this problem.

SUMMARY OF THE INVENTION

Accordingly, it is a principal object of the present invention to provide a developing apparatus wherein the developer is effectively prevented from scattering from the developing apparatus particularly when an impact is imparted thereto, or particularly when the developing apparatus is of a type wherein the developing apparatus is mountable into and demountable from an apparatus with which the developing apparatus is used.

It is another object of the present invention to provide a developing apparatus wherein an unsatisfactory developing operation which will be described hereinafter and which has been newly found as a problem stemming from the developer scattering, can be solved.

It is a further object of the present invention to provide a developing apparatus wherein the developer scattering is prevented while the developing operation can be performed satisfactorily.

It is a further object of the present invention to provide a developing apparatus wherein a developer surface regulating function of an elastic sheet is prevented from the deterioration which may be caused by the developer scattering resulting from rotation of the magnetic brush per se of the magnetic developer, by which the developer scattering can be prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Before describing the preferred embodiments of the present invention, the description will first be made with respect to the developing apparatuses from which the present invention starts, for the best understanding of the present invention.

Various types of dry-type developing methods and devices are known, among which various types based on the old magnetic brush development are widely used in practice.

In the magnetic brush based type developing apparatus, use is made, as the magnetic developer, of the so-called two component magnetic developer containing toner particles each having a particle size of about 1–20 microns and magnetic particles (carrier particles) having a particle size of about 20–200 microns mixed therewith, or a so-called one component magnetic developer containing magnetic toner particles each containing several tens percent of magnetic particles dispersed in a toning material. The magnetic developer is carried as a layer of the magnetic particles on a surface of a developer carrying member containing magnetic field generating means therewithin or having magnetic properties by itself utilizing the magnetic confining force, and is brought to a developing zone wherein the surface of the developer carrying member and a latent image bearing member for bearing the latent image to be developed are opposed, whereby the latent image is developed by the toner.

Figure 3:
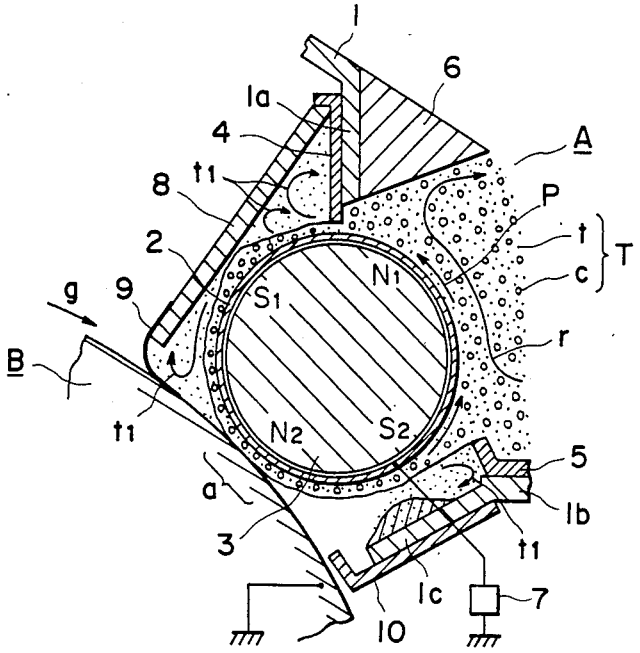
FIGS. 3 and 4 are cross-sectional views of developing apparatuses from which the present invention starts.

Referring to FIG. 3, the developing apparatus is generally depicted by a reference A, while a part of the latent image bearing member is indicated by a reference B.

The latent image bearing member B is representative of a rotatable photosensitive drum or a rotatable photosensitive belt in an electrophotographic apparatus, for example, or a rotatable dielectric drum or a rotatable dielectric belt in an electrostatic recording apparatus. On the latent image bearing member B, an electric latent image is formed by a known proper latent image forming means 16, and the surface of the latent image bearing member moves in the direction indicated by an arrow g toward the developing apparatus A. In the following description, the latent image bearing member B is called simply "drum" for the sake of simplicity.

The developing apparatus A includes a developer container 1, a part of which is shown in FIG. 3, a rotatable sleeve 2 of non-magnetic material functioning as the developer carrying member, and a fixed (non-rotatable) magnet roller functioning as the magnetic field generating means inserted into the sleeve 2.

The sleeve 2 is disposed in an opening formed in the container 1, extending perpendicular to the sheet of the drawing, with its substantially half surface (right side surface in FIG. 3) within the container and with its substantially other half surface (left side surface) exposed to the outside. The sleeve 2 extends in a direction perpendicular to the sheet of the drawing and is supported rotatably about the center thereof. The sleeve 2 is driven by an unshown driving means, which may be the same as the driving means 17 shown in FIG. 2 which will be described hereinafter, at a predetermined peripheral speed in the counterclockwise direction as indicated by an arrow P. The left side half surface of the sleeve 2 is opposed to the drum B which extends parallel to the sleeve 2, with a small clearance therebetween to establish a developing zone a where the developing operation is executed.

A doctor blade 4 is mounted to an outer surface of a front wall 1*a* of the container 1 and has a free end (bottom end) constituting an upper edge of the opening of the container and opposed to the surface of the sleeve with a predetermined clearance. The doctor blade 4 functions as a developer layer regulating member. A magnetic member 5 is mounted to a bottom plate 1*b* of the container 1 and has a free end constituting the bottom edge of the opening of the container 1 and opposed to the surface of the sleeve with a small clearance. A magnetic particle confining member 6 is mounted to the inside surface of the front wall 1*a* of the container 1 to which the above described blade 4 is mounted. The developing apparatus is provided with a developing bias source.

Reference A depicts the developer accommodated in the container 1, and is in this embodiment a two component developer containing toner t and the magnetic particles c mixed therewith. However, the developer may be one component developer containing magnetic toner. The right half side surface of the sleeve 2 is within the container 1 and is always in contact with the developer T accommodated in the container.

The fixed magnetic roller 3 is provided with magnetic poles N1, S1, N2 and S2 at respective predetermined positions adjacent the periphery thereof. The magnetic pole N1 (N pole) cooperates with the blade 4 to regulate the amount of the developer applied on the sleeve. The magnetic pole S1 (S pole) is effective to retain the applied developer layer on the sleeve surface by magnetic force to carry the developer layer to the developing zone a. The magnetic pole N2 (N pole) is positioned in the developing zone a. The magnetic pole S2 (S pole) is effective to retain by magnetic force on the sleeve surface the developer layer remaining on the sleeve after passing through the developing zone to carry it back into the container.

The developer T in the container 1 is stirred in the container 1 by an unshown stirring member provided in the container 1 or by the rotation of the sleeve 2 making it flow. The developer T is contacted to the surface of the rotating sleeve, with the magnetic particles and with the blade 4, whereby the toner t is electrically charged to a predetermined polarity. The developer T in the container 1 flows in the direction indicated by an arrow r in the neighborhood of the surface of the sleeve 2. The developer adjacent the sleeve surface in the container 1 is retained on the right half surface in the container 1 as a magnetically deposited layer by the magnetic field provided by the magnet roller 3 in the sleeve 2. The magnetically deposited layer is conveyed toward the doctor blade 4 by the rotation of the sleeve 2, and is passed through the clearance formed between the sleeve 2 and the free end of the blade 4. During this passage, the clearance and the magnetic field formed between the blade 4 and the magnetic pole N1 cooperate to regulate the thickness of the magnetically deposited layer of the developer or the amount of the developer, on the sleeve surface, and therefore, the amount of the developer applied on the developing sleeve 2 is regulated.

In this embodiment, the developer thus applied on the sleeve surface contains the toner particles t and the magnetic particles c, downstream of the blade 4 with respect to the direction of the sleeve surface movement.

With the continued sleeve rotation, the applied developer layer on the sleeve 2 is retained and confined on the surface of the sleeve 2 by the magnetic field provided by the conveying magnetic pole S1 and is conveyed to and passed through the developing zone a.

During the developer layer passing through the developing zone a, the toner t is transferred from the developer layer to the surface of the drum B in accordance with the pattern of the latent image formed on the surface of the drum B, by and with the aid of the magnetic field provided by the developing magnetic pole N2 and the developing bias.

With the further continued rotation of sleeve 2, the remaining developer layer having passed through the developing zone a is retained on the surface of the sleeve by the magnetic field provided by the conveying magnetic pole S2 and is conveyed through the clearance between the magnetic member 5 and the sleeve 2 and is collected into the developer container 1, more particularly into the developer accumulated portion therein. A magnetic sealing function is provided in the clearance between the magnetic member 5 and the sleeve 2 so as to prevent leakage of the developer from the container 1 through the clearance, as disclosed in detail in U.S. Pat. No. 4,638,760.

By continuous execution of the above described steps, the latent image on the surface of the drum B is sequentially developed.

In this system, the sleeve 2 may be fixed, that is, non-rotatable sleeve, within which a magnet roller 3 is rotated in the clockwise direction. In this case, the developer layer is conveyed along and on the fixed surface of the sleeve 2 similarly to the above-described case wherein the sleeve 2 is rotated in the counterclockwise direction P.

In FIG. 3, an upper sleeve cover 8, an insulative elastic seal member 9, a bottom sleeve cover 1*c* and a toner scattering preventing member 10 are provided in association with the left half surface of the sleeve 2 exposed to the outside of the developer container 1. The upper sleeve cover 8 covers the upper part of the left half surface of the sleeve. The elastic sealing member 9 is made of a polyethylene terephthalate sheet (trade name, MYLER) having a thickness of 10–30 microns, for example. The sealing member 9 has a base portion mounted to the cover 8 and a free end which is surface-contacted to the surface of the drum B to close the clearance between the drum B and the free end of the cover 8. The bottom sleeve cover 1*c* is, in this example, an extension of the bottom plate of the container 1*b*, and is effective to cover the bottom portion of the left half of the sleeve. The toner scatter preventing member 10 is mounted to the cover 1*c* to reduce the clearance between the free end of the cover 1*c* and the drum B as much as possible. In this manner, the externally exposed portion of the sleeve 2 is substantially enclosed and sealed. This is intended to prevent the toner from scattering from the developing apparatus to the outside thereof.

However, when the developing speed is increased, when the developing apparatus is so designed to be mountable into and demountable from a recording apparatus or when the developing apparatus is designed to be displaceable between a developing position and a non-developing position in the recording apparatus, the problem of the toner scattering acquires additional aspects which are considered to be caused by a possible reverse rotation of the sleeve 2 and the possible impact to the developing apparatus.

Investigations as to how the toner is scattered have revealed, as shown by arrows in FIG. 3, that smoke of toner powder $t_1$ is particularly produced or tends to be produced at the following positions:

(1) Immediately after the developer layer on the sleeve 2 passes by the blade 4;

(2) The neighborhood of the developing zone a through which the developer layer on the sleeve 2 is passed in contact with the surface of the drum B;

(3) Immediately before the remaining developer layer, after passing through the developing zone, is conveyed into the container 1 through the clearance (magnetic seal) between the magnetic member 5 and the sleeve 2; and (4) The neighborhood of the magnetic pole S1 opposed to a conveying path from the inside of the developer container 1 and the developing zone a on the sleeve 2. The portion of the developer layer being passed by the magnetic pole position is formed into a long brush due to the maximum magnetic force provided at the pole position, and after passing by the pole position, the brush falls, at which time, the resulting impact produces the smoke of toner powder.

Figure 4:
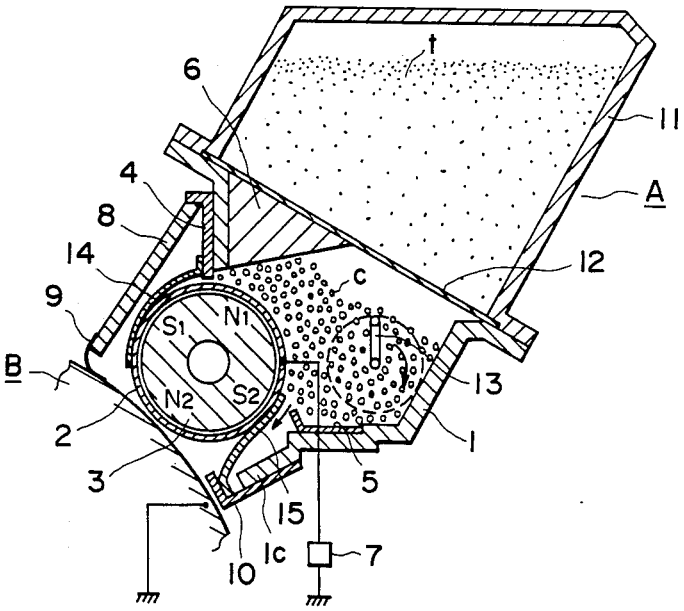

Referring to FIG. 4, an attempt has been made to prevent toner scattering, by elastic sheets 14 and 15 being provided along the entire length of the peripheral surface of the sleeve 2 with its one lateral end fixed and the other lateral end free. It has been confirmed that this is sufficiently effective to develop several thousands sheets without toner scattering. Moe particularly, the elastic sheet 14 has a fixed end which is fixed to an outside surface of the blade 4 and the other free lateral end extending substantially codirectionally with rotation of the sleeve 2. The free end portion is in contact with the developer layer on the sleeve at its surface near the sleeve surface. On the other hand, the elastic sheet 15, has a fixed end which is fixed to an inside of the scatter preventing member 10 and an opposite end which is free end. The free portion is extended codirectionally with the sleeve rotation. The free end portion is in contact with the developer layer on the sleeve at its surface near the sleeve.

However, this arrangement has turned out to be a temporary solution and gives rise to additional problems.

The additional problems are different for the elastic sheet 14 than for the elastic sheet 15 in the causes thereof. Generally, however, the problems result from the intended resiliency or elasticity of the elastic sheet 14 and 15 being deteriorated to disturb conveyance of the developer layer on the sleeve which should function as the developer conveying member.

More particularly, with respect to the elastic sheet 14, the toner particles having been scattered in the space before the developing zone a accumulatively deposited on the surface of the elastic sheet 14 remote from the sleeve 2 to produce force to urge the elastic sheet 14 to the sleeve 2. This is remarkable where the developer layer is contacted to the surface of the drum B in the developing zone a or where an alternating electric field (a symmetrical AC field, an asymmetrical AC field biased by a DC field or another bias such as pulse bias) is formed in the developing zone to vibrate the developer or reciprocate it between the sleeve 2 and the drum B. If this occurs, the degree of conformity of the elastic sheet 14 to the developer layer varies, and the variation is increased by an uneven distribution of the amount of the toner accumulated thereon along the length of the sleeve, with the result that the developer layer conveyance becomes unsatisfactory deteriorating the stable developing operation.

With respect to the elastic sheet 15, the amount of the accumulated toner increases more quickly than on the elastic sheet 14, and therefore, even in the case of a replaceable developing apparatus as well as the case of a permanently usable developing apparatus, the accumulated toner urges the elastic sheet 15 upwardly after several thousands of sheets are developed. If this occurs, the elastic sheet 15 unintentionally functions as a non-uniform obstruction to the developer going to be collected back into the developer container to increase the toner scatter, or the accumulated toner per se falls to the outside of the developing apparatus (if the elastic sheet 15 is not used, the toner accumulated on the extension 1*c* is agglomerated and falls due to its own weight or vibration imparted to the apparatus to contaminate the inside of the apparatus with which the developing apparatus is used). It is noted that, even if the developer (toner t and the carrier C) falls through the clearance between the sleeve 2 and the magnetic member 5 to below the elastic sheet 15, the developer accumulates at the back side of the elastic sheet 15, so that the agglomerated toner is prevented from falling from the developing apparatus, and therefore, it is a possible solution to increase the volume of the space between the elastic sheet 15 and the upper surface of the extension 1*c*. However, it will make the apparatus bulky, and therefore, is not preferable.

The elastic sheets 14 and 15 involve different problems peculiar thereto, respectively, and therefore, in an actual developing device, one or both of the problems are involved. Therefore, it is extremely desirable to provide a common solution thereto. In view of the above, the present invention is intended to provide a stable conveyance of the developer layer without applying too large load to the developer layer on the developer carrying member.

According to an embodiment of the present invention, there is provided a dry-type developing apparatus comprising a developer container for containing a developer, a developer carrying member, disposed in an opening of the developer container, for carrying the developer, and a continuous elastic sheet. Including a contact portion adapted to be contacted to a surface of the developer carried on the surface of the developer carrying surface and upstream and downstream fixed portions fixed to the developer container at upstream and downstream portions of the contact portion with respect to movement direction of the developer.

Here, the continuous elastic sheet includes a sheet constituted by one member and uniformly made of the same material or a sheet produced by connecting plural members or plural members which are combined into a multi-layer structure.

The present invention covers any structures wherein one or more elastic sheets as defined above are included in the developing apparatus.

Figure 1:
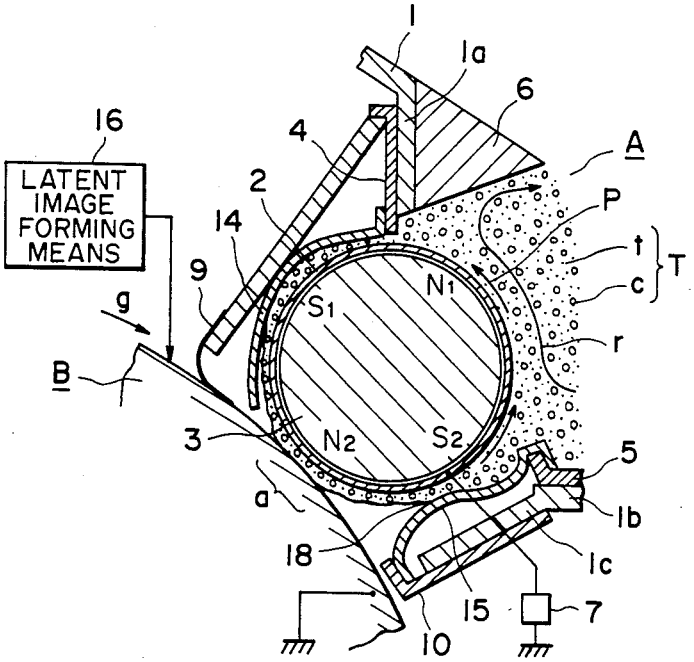
FIG. 1 is a cross-sectional view of a major part of the developing apparatus according to an embodiment of the present invention.
Figure 2:
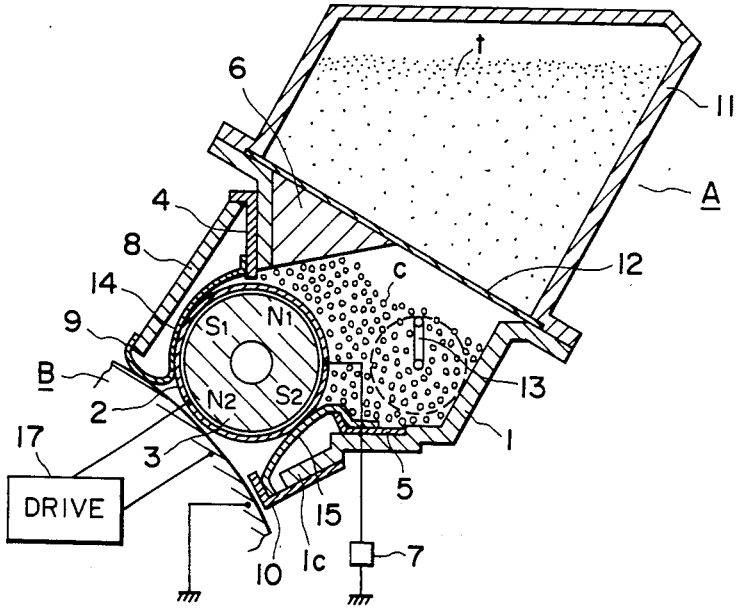
FIG. 2 is a cross-sectional view of a major part of a developing apparatus according to another embodiment of the present invention.

Referring now to FIGS. 1 and 2, embodiments of the present invention will be described. In the following description, the detailed explanation is omitted for the sake of simplicity as to some elements by assigning the same reference numerals as in FIGS. 3 and 4 to the elements of this embodiment which have corresponding functions.

In FIG. 2, the developing apparatus is shown as having a toner container 11 mounted integrally on the top of the developer container 1. Before use, the developer container 1 and the toner container 11 are partitioned by a sealing member 12 at the boundary therebetween, so that the developer container 1 contains a predetermined amount of the magnetic particles c only, whereas the toner container 11 contains a predetermined amount of toner particles t only. When the developing apparatus is mounted into an image forming apparatus and is to be used, the sealing member 12 is pulled out to allow the toner t in the toner container 11 to fall into the developer container 1. Then, the toner t and the magnetic particles c are mixed within the developer container 1 by a stirring member 13, whereby two component developer t is produced.

An elastic sheet 14 in FIG. 1 is disposed in a space between a top surface of the left half sleeve exposed externally from the developer container 1 and the upper sleeve cover 8. The upstream end (right end) portion of the elastic sheet 14 is securedly mounted to the outer surface of the doctor blade 4 adjacent the free end of the doctor blade 4. The elastic sheet 14 constitutes a first soft flexible and elastic sheet or film member, and will hereinafter be called "first sealing member". The opposite end of the first sealing member (left end) is extended to a neighborhood of the developing zone a and constitutes a free end. The first sealing member has a length and width to correspond substantially to the entire top sleeve surface of the left half of the sleeve. In this embodiment, the toner accumulated on the elastic sheet 14 is so small that it can be neglected in the design of the developing apparatus.

Another elastic sheet 15 is disposed in the space formed by a bottom sleeve surface of the left half of the sleeve 2, members 1*c* and 10 for covering the bottom surface. The elastic sheet 15 has an upstream end (left end) portion fixed to a back side of an end portion of the member 10, and it constitutes a second soft, flexible and elastic sheet or film which will be hereinafter called "second sealing member". The other end (right end) portion is securedly mounted to the magnetic member 5, covering the surface of the free end portion of the magnetic member 5. The second sealing member has a length and width to cover the entire bottom sleeve surface of the left half of the sleeve 2.

As will be understood, the elastic sheet 15 is so constructed as to form closed space at the inside as to be in contact with the developer layer on the sleeve 2 at the outer side. Therefore, the clearance between the container 1 and the developer layer can be substantially sealed by the physical wall constituted by the sheet itself, and the developer is prevented from going into the inside of the elastic sheet 15. For this reason, the amount of the developer accumulated at the inside of the elastic sheet is greatly reduced to a few degrees of accumulation, by which the intended elasticity of the elastic sheet is not deteriorated. It is preferable that the longitudinal ends of the elastic sheet 15 are contacted to longitudinal end walls of the container 11 or are contacted to additional sealing members such as sponge or the like to further feel the closed space. It should be noted, however, that without the additional seal, the developer scatter preventing effect provided by the elastic sheet 15 is even better than conventional sealing. The elastic sheet 15 according to this embodiment exhibits the tendency of retaining on its surface the developer which has conventionally been scattered, but it is collected back into the container 1 by the succeeding developer with certainty.

Therefore, the elastic sheet 15 in this embodiment is capable of assuredly preventing the toner scattering for a long period of time.

In addition, in this embodiment, the elastic sheet 15 is in contact with the developer layer also at a position opposed to the conveying magnetic pole S2, and therefore, the scatter preventing effect itself is excellent. Further, the sheet 15 is effective to provide an additional sealing effect when the magnetic sealing effect between the magnetic member and the magnetic pole S2, which is disposed upstream of the free end of the magnetic member 5 with respect to the rotational direction of the sleeve, deteriorates by, for example, possible mechanical vibration.

Each of the first and second sealing members 14 and 15 are made of a polyethylene terephthalate sheet or film (trade name, MYLER) having a thickness of 10–50 microns, for example, or such a sheet or film coated with evaporated magnetic material or with magnetic material dispersed resin as a thin layer, such as an audio tape having soft, flexible and elastic property in its entirety. An audio tape may be usable as the first and/or second sealing members as magnetic ones. By the magnetic property, the first and/or second sealing members can be more in conformity with the developer layer on the sleeve 2 so that the scatter preventing effect is enhanced.

When the sleeve 2 is rotated, the developer layer is magnetically retained on the surface of the sleeve 2 in the manner described in conjunction with FIGS. 3 and 4, and is conveyed to the developing zone a to develop continuously the latent image on the surface of the drum B with the toner into a visualized image.

In this operation, the first and second sealing members 14 and 15 disposed in association with the top surface portion and bottom surface portion of the sleeve 2, respectively, of the left half of the sleeve which is externally exposed from the developer container 1, are softly surface-contacted to the outer surface of the developer layer on the sleeve in conformity therewith.

The second sealing member 15 covers the external surface of the developer layer on the bottom surface portion of the sleeve 2 immediately before the remaining developing layer having passed through the developing zone a and having passed through the clearance (magnetic seal) between the magnetic member 5 and the sleeve 2 going into the container 1, whereby the possible production of the toner powder smoke from the developer layer is prevented.

The developer layer portion covered by the sealing member 15 is lightly contacted to the surface of the sealing member 15 and is conveyed without obstruction, and the provision of the sealing member 15 does not obstruct the conveyance of the developer layer, so that the developer is not stagnated. Therefore, effective prevention can be provided against the production per se of the smoke of the toner powder from the developer layer magnetically retained and conveyed on the surface of the sleeve 2 in the operation of the developing apparatus, and therefore, the problem of the deterioration in the image quality and the problem of machine contamination which otherwise result from the toner smoke can be satisfactorily solved. Additionally, since the seal 15 is fixed at opposite lateral ends, the necessity is eliminated to provide a large space, so that the size of the apparatus can be reduced.

In this embodiment, the toner particles t are non-magnetic toner particles each having a particle size of 7–20 microns and each contains as major components 10 parts of carbon and 90 parts of polystyrene. To the toner powder, silica particles may be added to increase its fluidability. Further, abrasive particles may be added thereto to abrade the surface of the drum B functioning as the latent image bearing member in the case of, for example, an image transfer type image forming apparatus. The toner particle may contain a small amount of magnetic particle or particles. More particularly, magnetic toner may be usable if the magnetic property is very weak as compared with that of the magnetic particles and if it is triboelectrically chargeable.

The developer layer formed on the developing sleeve 2 may be a mixture of the non-magnetic toner particles and magnetic particles or may contain magnetic toner particles only. In the case that the elastic sheets 14 and 9 are continued (FIG. 4), the developer layer may contain non-magnetic toner only.

As for the sleeve 2, a cylindrical member of electrically conductive material such as aluminum, brass and stainless steel or a cylindrical member of paper or synthetic resin, are usable. Further, the surface of the cylinder may be treated to be conductive, or the surface is of dielectric material, by which it is made to function as a developing electrode, too. As another example, a core roll is used and is wrapped with conductive elastic member such as a conductive sponge. The sleeve 2 may be in the form of an endless belt.

The number and the positions of the magnetic poles of the roller 3 are not limited to those in the examples described in the foregoing. The polarities of the magnetic poles may be the opposite. The magnetic pole N2 at the developing zone a has been shown as disposed in the center of the developing zone, but it may deviate from the center. Alternatively, the developing zone may be disposed between magnetic poles. The magnet roller is of a permanent magnet, that may be an electromagnet. If the magnetic member 5 is not used, the magnet roller 3 may be a rotatable type. In this case, the fixed end of the sheet 15 is fixed on the bottom of the container 1.

The material of the blade 4, in this embodiment, is a non-magnetic material such as aluminum at least at its free (bottom) end. The blade 4 extends longitudinally along the length of the sleeve 2 at a position adjacent the top end of the opening. The base portion of the blade 4 is fixed to the container 1, and the free end is opposed to the surface of the sleeve 2 with a predetermined clearance. The clearance is 50–500 microns, preferably 100–350 microns, and is 250 microns in this embodiment. If the clearance is smaller than 50 microns, the clearance is easily clogged with the magnetic particles, whereas if it is larger than 500 microns, too large of an amount of the magnetic particles and toner are passed through the clearance, with the result that the proper thickness of the developer layer can not be formed on the sleeve 2. The thickness of the developer layer is smaller than the clearance between the surface of the drum B and the surface of the sleeve 2 at the developing zone a. Here, the thickness of the developer layer is the one measured when no magnetic force is applied and measured on the sleeve 2. In order to form the developer layer of such a thickness, the clearance between the free end of the blade and the sleeve surface is preferably comparable to or smaller than the clearance between the surfaces of the sleeve and the drum, but it may be larger than that. The power source 7 is functioned to apply a voltage across the clearance between the drum B and the sleeve 2 to form an alternating electric field across the clearance to transfer the toner in the developer layer on the sleeve 2 to the drum B. The voltage supplied by the source 7 may be symmetrical having the same peak voltage at the positive and negative sides, or may be asymmetrical in the form of an AC voltage superimposed with a DC voltage. As an example, when the dark potential of the latent image is −600 V, and the light potential is −200 V, an alternating voltage having a peak-to-peak voltage of 300–2000 Vpp and having a frequency of 200–3000 Hz superimposed with a DC voltage of −300 V is applied to the sleeve 2, while the drum B is grounded.

To the toner scatter preventing member 10, a voltage having the same polarity as the toner particles may be applied. By this, the toner scattered from the developing area is urged to the drum B by the electric field, whereby the scatter of the toner can be prevented.

In order to prevent occurrence of a ghost image, the remaining developer layer on the sleeve 2 which has not been consumed in the developing operation is scraped by an unshown scraper means when it is returned into the developer container 1, and the scraped surface of the sleeve 2 is contacted to the magnetic particle layer to be coated again with the developer.

An automatic toner content control mechanism may be employed, by which the content of the toner and/or the magnetic particles in the developer is detected, in response to which the toner is automatically supplied into the container.

The developing device A may be of a disposable type containing as a unit the container 1, the sleeve 2 and the blade 4. Or, it is may be of an ordinary type which is fixed in an image forming apparatus.

Referring to FIG. 2, there is shown an another embodiment of the present invention. Since this embodiment is similar to the foregoing embodiment, except for the portions which will be described, the detailed explanation is omitted for the sake of simplicity by assigning the same reference numerals to the elements having corresponding function. In this embodiment, the concept of the present invention is applied also to the first sealing member. However, the present invention covers the structure wherein the second sealing member 15 is not in the type described in conjunction with FIG. 1, as long as the first sealing member is of the structure shown in FIG. 2, in this embodiment.

The first sealing member 14 of FIG. 2 also functions as the sheet 9 of FIG. 1 embodiment, in other words, the sheets 14 and 9 of FIG. 1 are made integral. More particularly, the free end of the sheet 9 and the free end of the sealing member 14 are connected in a smooth curvature to make them integral. As an alternative structure, free the end of the first sealing member 14 may be slightly extended to be directly fixed to the cover 8.

According to the first sealing member 14 of FIG. 2, the scattered toner is prevented from entering the space between the sealing member 14 and the cover 8, so that the toner is prevnted from being accumulated on the sealing member 14. Therefore, the contact of the sealing member 14 to the developer layer is stabilized, thus avoiding sealing member 14 from causing developer scattering. For this reason, the developer layer is not disturbed, and the developer layer being supplied into the developing zone can be stabilized, thus further stabilizing the developing action.

According to the structure of FIG. 2, the toner is further prevented from being accumulated on the sheet, so that agglomerated toner falling can be prevented.

Applying the present invention both to the first and second sealing members 14 and 15 is further preferable since then the developing action and the toner scatter preventing action are enhanced as a whole.

The present invention covers any structure wherein the above described structures are combined. The elastic sheet means here any sheet that has an elasticity by itself or that is used with another elastic member to contact the developer layer substantially elastically. In this case, the sheet or film member described above is flexible and elastic to be softly contacted to the external surface of the layer of the developer retained on the sleeve, so that in practice, the conveyance of the developer magnetically retained on the developer carrying member surface is not obstructed or stagnated.

As described above, according to this embodiment, a continuous elastic sheet is elastically contacted to the developer layer on the developer carrying member surface to prevent the toner scattering which otherwise may be caused by the disturbance of the developer layer per se, and also to eliminate the possibility of the elastic sheet itself becoming a cause of disturbing the developer layer in a long term use. Therefore, the developing operation is stabilized for a long period of time.

Referring back to FIG. 1, reference numeral 18 designates a position at which the contact starts between the elastic sheet 15 and the magnetic developer layer. In this embodiment, the starting position 18 is upstream of the center of the magnetic pole S2 which is effective to form a concentrated magnetic field in cooperation with the magnetic member 5, with respect to the rotational direction of the sleeve 2. This is advantageous because the sheet 15 covers the portion at which the magnetic developer layer starts to be disturbed by the rotation of the magnetic brush and also because the state of the developer layer can be stabilized at this position. Thus, the toner scatter prevention can be stabilized. Further, since the elastic sheet 15 forms a contact portion with the developer layer in a position opposed to the magnetic pole S2, the developer in the container is prevented from scattering by the combined effect with the magnetic seal function. Additionally, since the elastic sheet 15 is disposed in the clearance between the magnetic member 5 and the magnetic pole S2, the magnetic developer collecting function and the leakage preventing function can be enhanced without disturbing the magnetic sealing effect.

While the invention has been described with reference to the structures disclosed herein, it is not confined to the details set forth and this application is intended to cover such modifications or changes as may come within the purposes of the improvements or the scope of the following claims.

What is claimed is:

1. A dry-type developing apparatus, comprising:

a developer container for accommodating a magnetic developer, said developer container being provided with an opening;

developer carrying means, disposed in the opening, for carrying the magnetic developer out of said developer container, said developer carrying member including magnetic field generating means which is provided with magnetic field generating portions having different polarities arranged in a direction of carrying the magnetic developer; and a continuous elastic sheet including a contact portion for contacting the magnetic developer carried out of said developer container by said developer carrying means and having upstream and downstream fixed portions which are respectively fixed to said developer container at positions upstream and downstream of the contact portion with respect to movement of the magnetic developer.

2. An apparatus according to claim 1, further comprising a magnetic member, disposed within said developer container and at a lower portion thereof, for cooperating with said magnetic field generating means which is unmovable to form a concentrated magnetic field, wherein said elastic sheet is disposed at a lower position of said developer container, and wherein the upstream fixed portion is disposed adjacent the opening of said developer container, and the downstream fixed portion covers said magnetic member.

3. An apparatus according to claim 2, wherein said elastic sheet starts to contact the magnetic developer at a position upstream of a center of the magnetic field provided by said magnetic field generating means with respect to movement direction.

4. An apparatus according to claim 3, wherein an area of contact between the elastic sheet and the magnetic developer is opposed to said magnetic field generating means.

5. An apparatus according to claim 1, wherein said elastic sheet is of non-magnetic material and having a thickness not less than 10 microns and not more than 50 microns.

6. An apparatus according to claim 1, wherein said elastic sheet is contactable to a surface of said developer carrying means without the magnetic developer thereon and is formed into a convex shape toward the surface of said developer carrying means.

7. An apparatus according to claim 1, wherein the magnetic developer contains magnetic carrier particles and toner particles mixed therewith.

8. An apparatus according to claim 6, wherein said developing apparatus is detachably mountable into an image forming apparatus.

9. An apparatus according to claim 1, wherein the upstream fixed portion of said elastic sheet is fixed to a regulating blade mounted to said developer container to regulate an amount of the magnetic developer carried out of said developer container, and wherein said elastic sheet further includes a contact portion for contacting to a surface of an image bearing member for bearing an image to be developed by said developing apparatus, between the first mentioned contact portion and the downstream fixed portion.

10. An apparatus according to claim 1, wherein said contact portion is opposed to one of said magnetic field generating portions.

11. An apparatus according to claim 10, wherein said elastic sheet has a thickness not less than 10 microns and not more than 50 microns.

12. An apparatus according to claim 1, wherein the magnetic developer contains magnetic carrier particles and toner particles mixed therewith, said developing apparatus further comprising means for forming a vibratory electric field in a developing zone where the magnetic developer on the surface of said developer carrying means is opposed to an image bearing member for bearing an image to be developed by said developing means.

13. A dry-type developing apparatus, comprising:

a developer container for accommodating a developer, said developer container being provided with an opening;

developer carrying means, disposed in the opening of said developer container, for carrying a developer out of said developer container;

an elastic sheet having an upstream end portion and a downstream end portion with respect to a direction of carrying the developer on said developer carrying means, the upstream end portion being adjacent a position where the developer is carried out of said developer container, the downstream end portion being disposed above a developing zone where a developing operation is performed, the upstream and downstream end portions being fixed to said developing apparatus, and said elastic sheet being a continuous sheet having a first contact portion for contacting the developer on said developer carrying means at one side thereof and a second contact portion being adapted to contact at the same side an image bearing member for bearing an image to be developed by said developing apparatus.

14. An apparatus according to claim 13, further comprising means for forming a vibratory electric field in the developing zone.

15. An apparatus according to claim 14, wherein the developer contains magnetic carrier particles and toner particles mixed therewith.

16. An apparatus according to claim 13, further comprising a second elastic sheet disposed downstream of the developing zone and having a contact portion for contacting the developer on said developer carrying member and portions which are upstream and downstream of the contact portion thereof and which are fixed to said apparatus.

17. A dry-type developing apparatus, comprising:

a developer container for accommodating a magnetic developer, said developer container being provided with an opening;

a rotatable sleeve disposed in the opening and having non-rotatable magnetic field generating portions therein;

a magnetic member disposed outside said sleeve in a region where said sleeve enters into said developer container through the opening, said magnetic member being cooperative with a magnetic pole of said magnetic field generating portions to form a concentrated magnetic field; and an elastic sheet having an end fixed to said magnetic member and extending through a clearance between said sleeve and said magnetic member.

* * * * *